US007624684B2

(12) United States Patent
Morris

(10) Patent No.: US 7,624,684 B2
(45) Date of Patent: Dec. 1, 2009

(54) CABLE SUSPENDED, SELF LEVELING TRAM WITH SELF-PROPELLED TRACTOR BOGIE

(76) Inventor: Richard David Morris, 21386 E. Wanderlust Pl., Parker, CO (US) 80138

( * ) Notice: Subject to any disclaimer, the term of this patent is extended or adjusted under 35 U.S.C. 154(b) by 169 days.

(21) Appl. No.: 11/891,025

(22) Filed: Aug. 9, 2007

(65) Prior Publication Data

US 2009/0038499 A1 Feb. 12, 2009

(51) Int. Cl.
*B61B 7/00* (2006.01)

(52) U.S. Cl. ..... 104/112; 104/173.1; 104/180; 104/115; 104/116; 105/150; 105/30

(58) Field of Classification Search ..... 104/112, 104/115, 116, 122, 123, 173.1, 173.2; 105/30, 105/150

See application file for complete search history.

(56) References Cited

U.S. PATENT DOCUMENTS 328,899 A * 10/1885 Morrison ..... 104/123
987,253 A * 3/1911 Neale ..... 104/115
1,360,097 A * 11/1920 Davino ..... 104/23.1
3,244,113 A * 4/1966 Smyser ..... 104/112
3,353,503 A * 11/1967 Pettit ..... 105/150
3,498,236 A * 3/1970 Meek ..... 105/30
3,847,085 A * 11/1974 Rypinski ..... 104/122
4,149,726 A * 4/1979 Tredway, Sr. ..... 473/235
4,492,168 A * 1/1985 Cellai ..... 105/30
4,641,587 A * 2/1987 Dalliard ..... 105/3
6,272,999 B1 * 8/2001 Pugin et al. ..... 104/125
6,494,141 B2 * 12/2002 Montambault et al. ..... 104/112

* cited by examiner

*Primary Examiner*—S. Joseph Morano
*Assistant Examiner*—Zachary Kuhfuss

(57) ABSTRACT

A cableway with suspended tram and remote bogie is disclosed. This includes a self-contained motor, traction and support sheaves with provision for adjusting the height of the tram below said cable for limiting vertical acceleration caused by travel along the cantenary curve of the cableway.

5 Claims, 7 Drawing Sheets

CABLE SUSPENDED, SELF LEVELING TRAM WITH SELF-PROPELLED TRACTOR BOGIE

BACKGROUND OF THE INVENTION

1. Field of the Invention

The present invention relates generally to a cable suspended tram with self-leveling car and remote tractor unit used primarily for the movement of people or goods at lower cost and higher speeds than current designs.

2. Description of the Prior Art

It is advantageous to use, cable structures to traverse rugged or congested terrain. Cable structures have been used to pull the tram in a close loop such as a chairlift or enable the use of an on board tractor drive system.

U.S. Pat. No. 2,198,536 issued to Fredrik Johnsen on Dec. 14, 1938 teaches us one method of ramping on to a support rail from a cableway but fails to show us how a capstan or containment roller would traverse the underside of the support rail.

U.S. Pat. No. 3,353,503 issued to Frank P. Pettit on Nov. 21, 1967 shows us a containment roller but no method of minimizing the vertical acceleration caused by the cantenary curve.

U.S. Pat. No. 4,211,171 issued to Rudolf Baltensperger on Jul. 8, 1980 disclosed a solution to the curvature of a cable supported pathways by using a cable with its structurally efficient curvature in combination with a rigid straight rail. The present invention does not need a costly rail and all the connections associated with it.

U.S. Pat. No. 4,641,587 issued to Fernand Dalliard on Feb. 10, 1987 disclosed a suspended motorized vehicle on two laterally spaced tracks. The rail tracks are suspended by a cantenary cable structure. The present invention does not require the two costly tracks or the associated connections.

U.S. Pat. No. 4,069,765 issued to Gerhard Muller on Jan. 24, 1978 disclosed a suspended motorized vehicle on two laterally spaced tracks. The rail tracks are suspended by a cantenary cable structure. The present invention does not require the two costly tracks or the associated connections.

U.S. Pat. No. 4,984,523 issued to Clarence A. Dehne on Jan. 15, 1991 discloses a Self-Propelled Trolley and track structure. Clarence does not attempt to address long spans or how a tram would be supported. The present invention does not require the use of a rigid track except at support towers.

U.S. Pat. No. 5,465,668 Issued to Serge Tarassoff on Nov. 14, 1995 discloses an overhead two cable transport. Serge uses traction cables and is not Self-Propelled. Serge does not disclose what would eliminate the vertical acceleration forces associated with high speed travel on a cantenary cableway.

U.S. Pat. No. 6,606,954 issued to Ben Lamoreaux on Aug. 19, 2003 disclosed an Elevated Cableway System. Ben uses a network of cables suspended from a cantenary cable to support a railway with various methods of eliminating deflection at the rail. The present invention will not need such an elaborate array of cables or connectors.

U.S. Pat. No. 6,910,425 B2 issued as a Continuation-In-Part describes a self-propelled trolley design to run on an enclose track. The present invention does not use an enclosed track and would not require the added cost of such a rigid structure except at the tower structures.

None of the above patents, taken either singly or in combination, is seen to describe the instant invention as claimed.

SUMMARY OF THE INVENTION

Accordingly it is the principle object of the invention to provide economical transportation for persons or goods at a higher rate of speed than the prior art.

This is accomplished by the use of a catenary cable, a tractor self-propelled bogie, a support tower for the cable the top of which is a curved rail and transition from the catenary cable, and a tram which is suspended from an adjustable cable attached to the bogie. The catenary cable is a very efficient way to span long distances. By using a curved rail at the top the support tower, the suspended and moving trolley will have a smoother ride. Additionally the cable suspending the tram adjusts to the change in elevation of the cableway making for an even smoother and faster ride by averaging out the ups and downs of the catenary cableway. The self propelled bogie pulls the suspended tram below along the cableway.

These and other objects of the present invention will become readily apparent upon further review of the following drawings and specifications.

Figure 1:
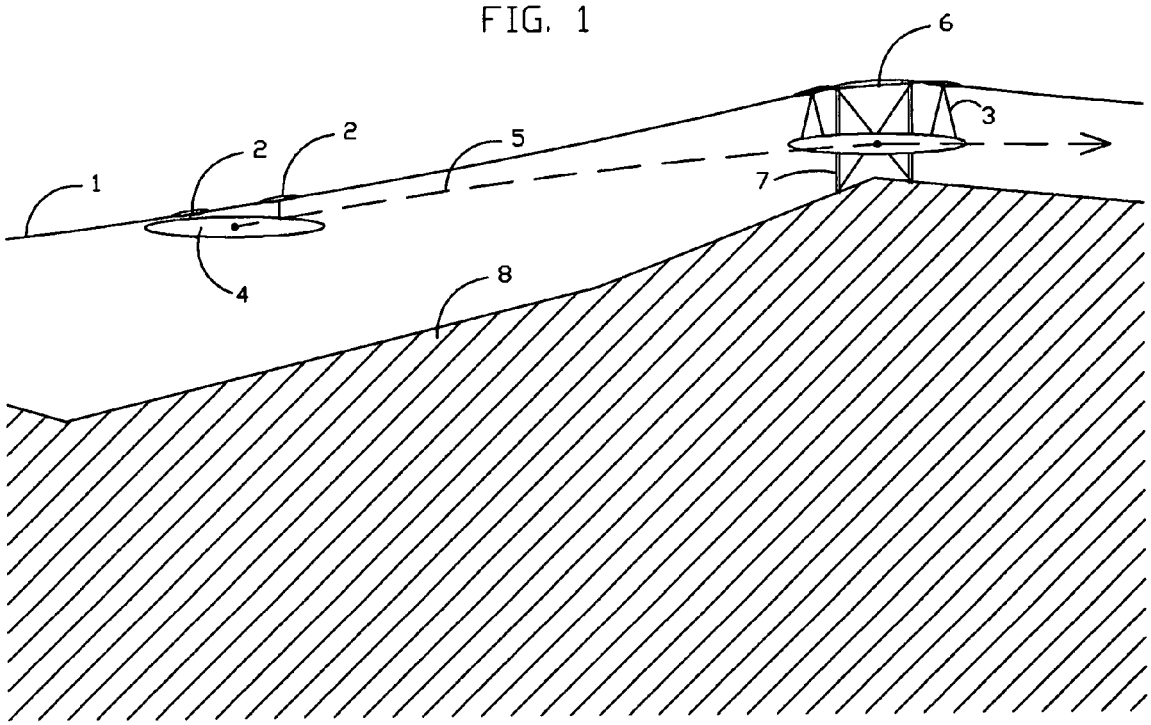
FIG. 1 is a diagrammatic elevation view of the cableway, tower, tram and bogie.

The parts correspond to the above listed figures according to the following list:

1. Cableway
2. Bogie
3. Vertical adjustment cable
4. Tram
5. Path of travel for tram
6. Transition rail
7. Tower
8. Earth
9. Traction sheave
10. Power supply
11. Pulley
12. Hydraulic ram
13. Luggage storage
14. Cable containment roller
15. Spring loaded axel
16. Clamping rail
17. Wearing surface
18. Support bracket
19. Whipping
20. Support bar
21. Motor
22. Block and Tackle
23. Support Beam
24. Sub-grade foundation
25. Centering spring
26. Slot track

27. Shock absorber
28. Lowered position
29. Elevated position
30. Above ground foundation
31. Controller
32. Vertical Fin

DETAILED DESCRIPTION OF THE PREFERRED EMBODIMENTS

A cableway with suspended trolley and remote tractor bogie is illustrated in FIG. 1. The cantenary cableway 1, is supported by a curved rail 6, designed to provide a radius of curvature from the upward slope approaching the support tower 7, to the downward slope of the cableway. A tram 4, is supported by adjusting cables 3, and pulled along the cableway by any number of self-propelled bogies 2. The resulting path 5, is accomplished by the aforementioned mechanics over the varied terrain 8.

Figure 2:
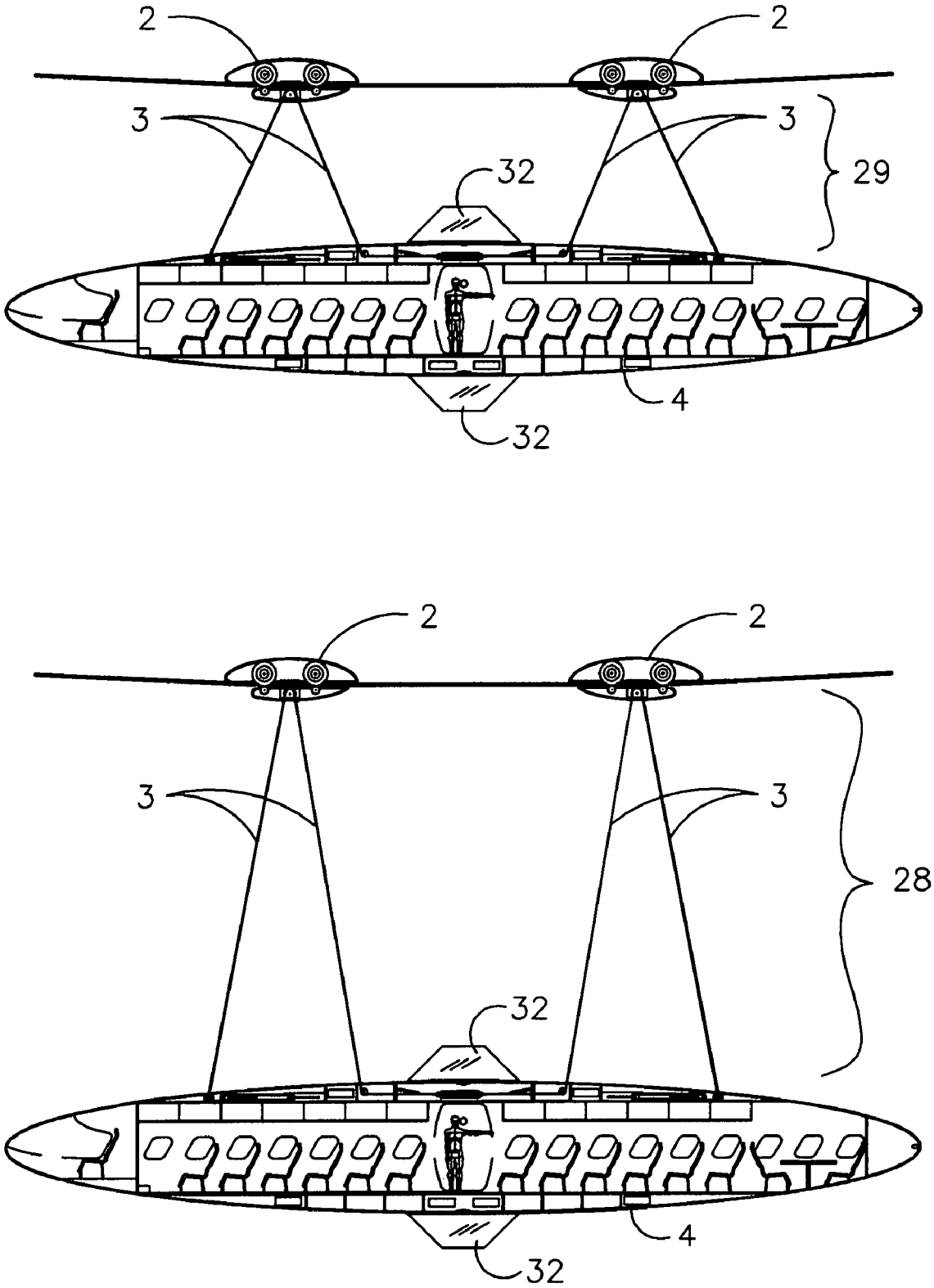
FIG. 2 is an section/elevation view of the tram, cableway, bogie, and adjustable nature of the suspension cables.

FIG. 2 shows a section/elevation of the tram 4, suspended by adjustable cable 3, and pulled by the bogie/trolley 2. This drawing illustrates the dynamic range of adjustment capable by the cable 3. Typically the tram pulls the cable in 29, at low points on the cableway and lets cable out 28, when approaching a high point along the route. Vertical fins 32, are added to counter act the crosswind forces and keep the tram centered under the cableway.

Figure 3:
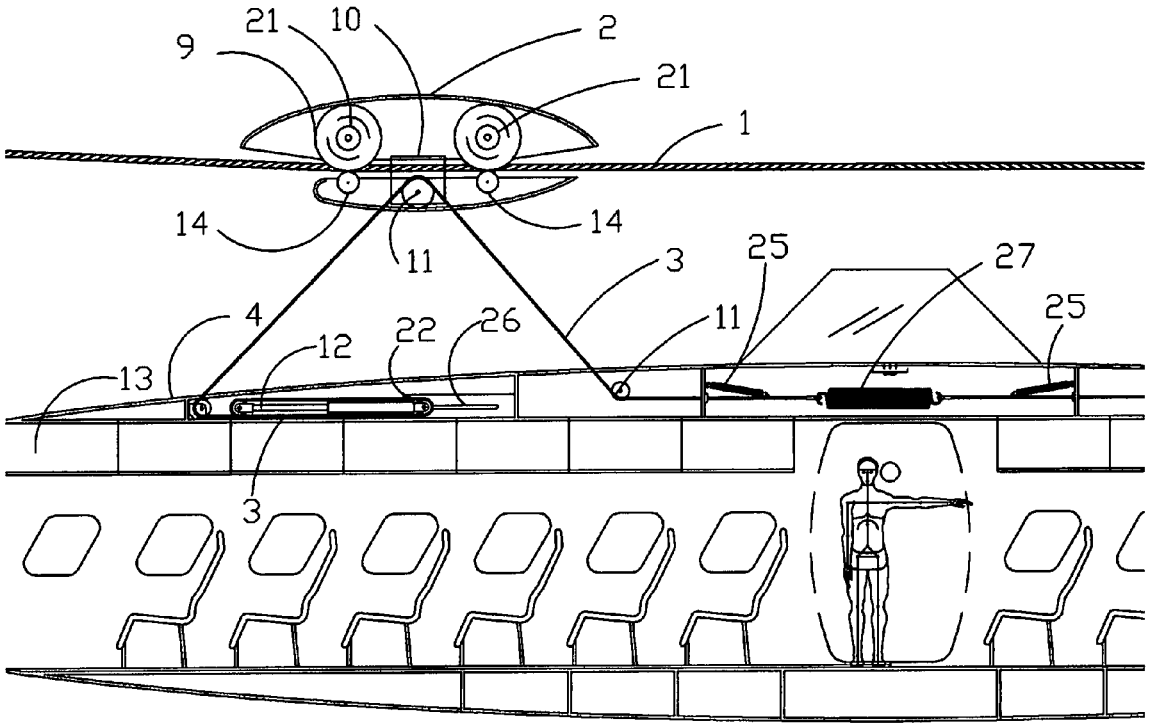
FIG. 3 is a section through the bogie and tram.

FIG. 3 is a sectional view of the trolley and vertical adjustment cable assembly 3. The traction sheave 9, is powered by a motor 21. The motor maybe direct drive or use a belt or geared system. Cable containment roller 14, is located to provide a constant force against the cable or rail to prevent the drive sheave from coming off the cableway. The preferred embodiment incorporates a power supply 10, for energy to drive the motor. The power supply is capable of high charge and discharge rates and is recharged at passenger terminal locations. A cable 3, is used to suspend the tram from the bogie. The pulley 11, is free to rotate thereby providing adjustment of the suspended height above the trolley. The cable is connected to the winch or hydraulically powered adjustment sheave 12. The winch or hydraulics is used controlled the vertical acceleration forces created by the tram following the cantenary curve. A block and tackle 22, is used to multiply the movement of the hydraulic ram and is free to travel along the slot 26. To cushion any vibrations caused by the trolley transitioning from the cableway to the support rail, a support pulley 11, routes the cable to a shock absorber system 27 and 25, in line with longitudinal line of the tram 4. The main shock absorber 27, is centered by springs 25. Luggage is accommodated by over head bins 13.

Figure 4:
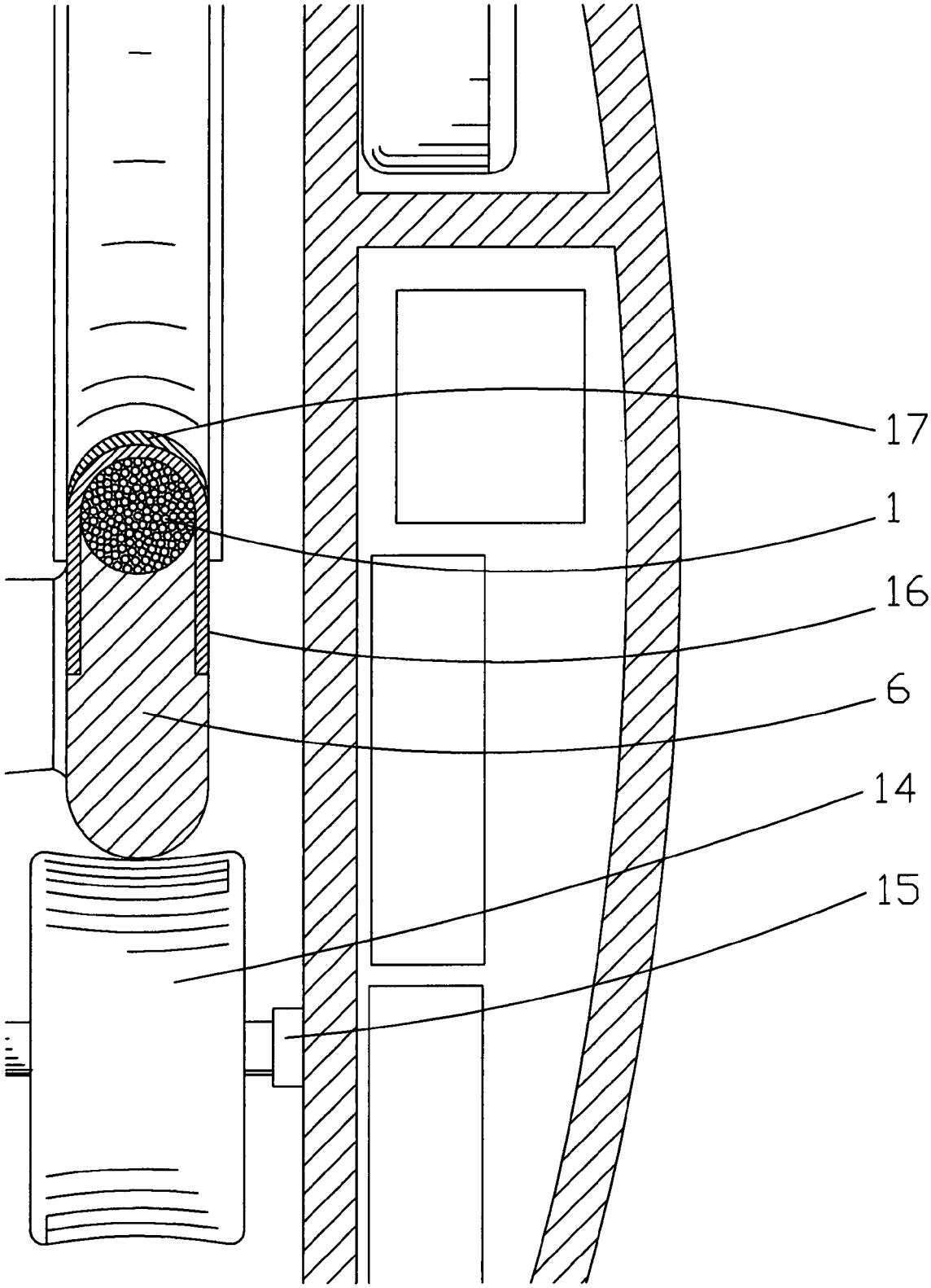
FIG. 4 is a section view through the support track at the tower and the bogie.

FIG. 4 is a cross section through the support rail 6, which has a cable clamp 16. The purpose of the rail is to provide the height required to connect the support bracket 18, to the support tower without disrupting the smooth transition from cableway to railway. The section of the rail can then be curved and tapered in any required direction. A wearing surface 17, is provided to minimize damage to the cableway. When the cable containment roller 14, comes in contact with the rail 15 it accommodates the change in depth by spreading apart from the traction sheave 9.

Figure 5:
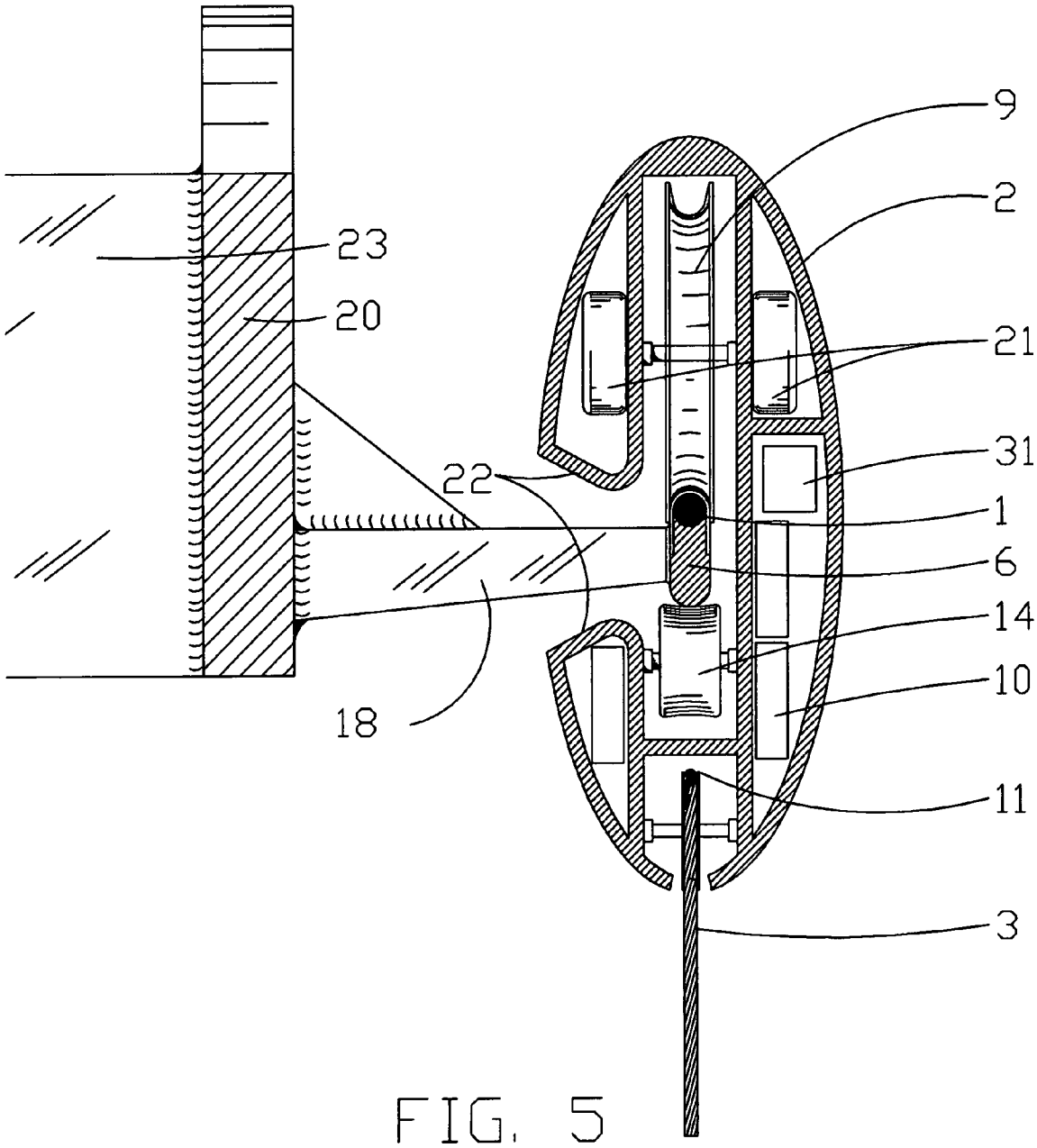
FIG. 5 is a section through the bogie at the support track showing the support beam.

FIG. 5 is a section at the tractor or bogie. The support bracket 18 is shown connected to the rail 15. The Sheave 9 rides on the rail or cable and is powered by a motor 21. The Cable containment roller 14, forces the cable or rail into the sheave to eliminate any chance of the sheave from coming off the rail or cableway. The shell 22, of the bogie is cutback away from the bracket support to enable the trolley to miss hitting the support bracket as the bogie passes by.

Figure 6:
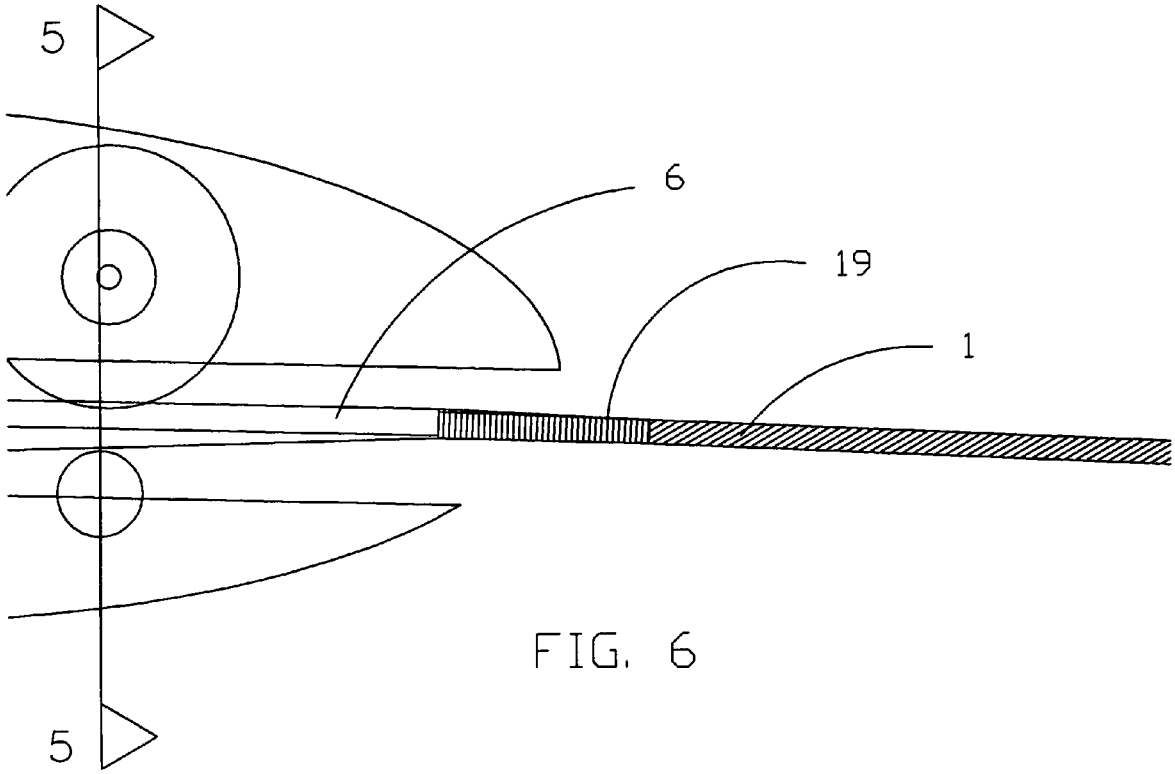
FIG. 6 is an elevation of the cableway transition to the support track.

FIG. 6 illustrates the cableway transitioning 19, to the support rail 6, where additional wire or whipping is wrapped around the cable 1, to ramp the sheave 9, up onto the rail which clamps the cable without any major bumps.

Figure 7:
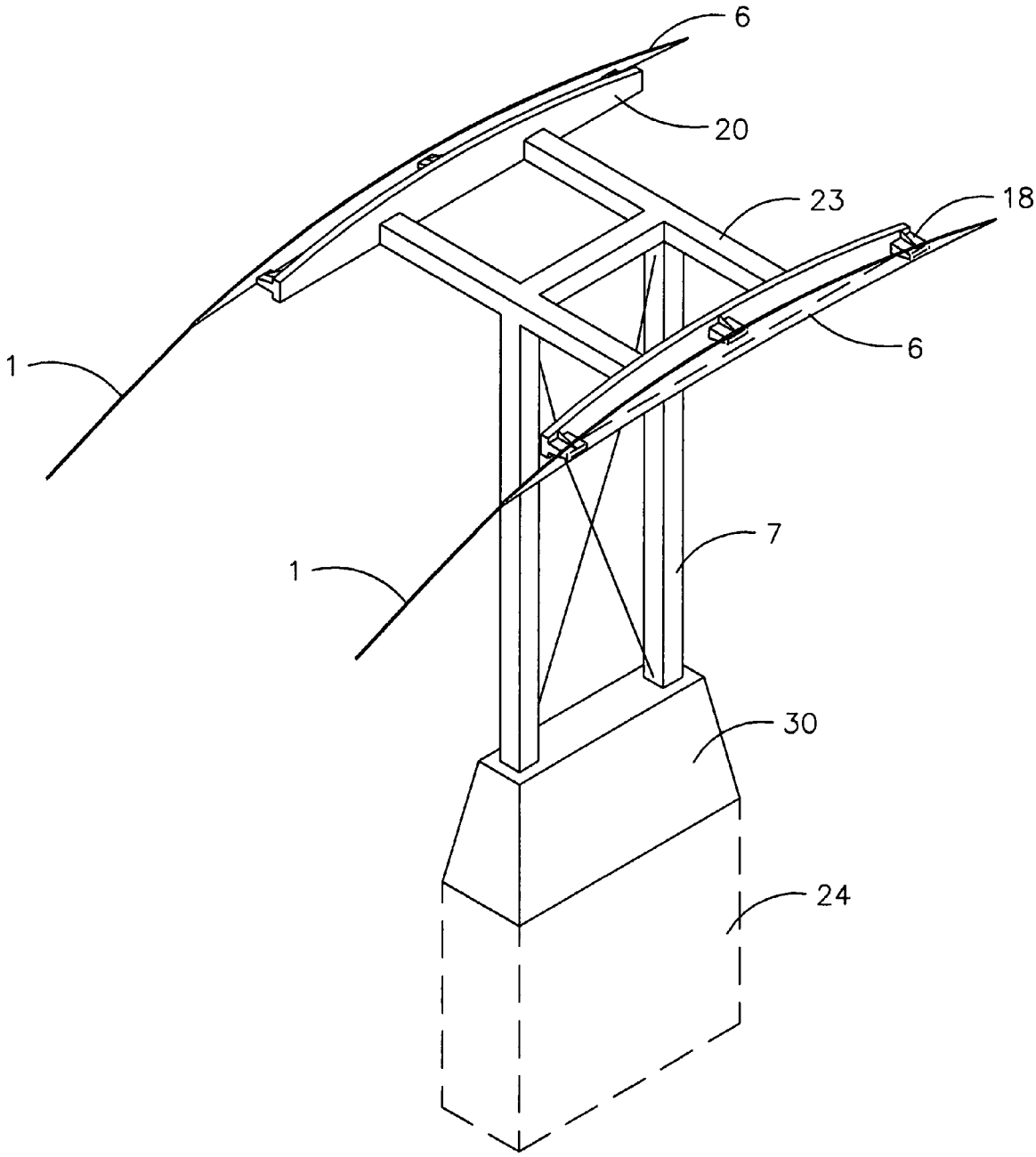
FIG. 7 is an isometric of the tower supporting the cableway.

FIG. 7 shows an isometric of the support tower. The tower can provide a horizontally curved rail 6, as maybe required by the route. Typically the rail is vertically curved to provide a smooth transition from the ups and downs of the cantenary curves. The rail is then supported by a plurality of brackets 18, which transfers the load back to the beam 20, thereby lessening the required depth of the rail and adjustment needed by the cable containment roller 14. Outriggers 23, then carry the load to the tower 7, and then on to the above ground foundation 30, and sub-ground foundation 24.

I claim:

1. A cableway (1) and/or rail (6) suspended motorized vehicle used for the transportation of passengers and/or freight comprising;

(a) a body designed to protect passengers and freight from the elements;

(b) one or more self-propelled bogies (2) containing motors (21) means connected to one or more traction sheaves (9) which travel along the cableway (1) or rail (6) which pull and suspend the tram (4) below by an adjustable cable (3) or other adjustable attachment whereby the elevation of the tram can be raised or lowered to minimize the vertical acceleration caused by travel along a catenary draped cableway and intersecting support towers.

2. A vehicle according to claim 1, where a rail (6) clamps the cableway (1) inside the rail and is curved in either the vertical or horizontal plane thereby decreasing the vertical acceleration and/or changing the horizontal direction of the bogie and increasing rail depth to accommodate the connection to support brackets (18) which transfer loads to a support bar (20).

3. A vehicle according to claim 1, where the said cableway (1) is thickened by whipping (19) thereby ramping up the traction sheave (9) onto a cable clamp (16) and rail (6).

4. A vehicle according to claim 1, where said self-propelled bogie (2) is powered by an electric motor (21) and battery (10).

5. A vehicle according to claim 1, where said tram has one or more vertical fins (32) which counter act the wind forces and keep the tram centered under the cableway while traveling at high speed and are proximately located near the aerodynamic center of the tram.

* * * * *